US005701355A

United States Patent [19]

Brannan et al.

[11] Patent Number: 5,701,355

[45] Date of Patent: Dec. 23, 1997

[54] MICROPHONE FOR A TWO WAY RADIO

[75] Inventors: Michael H. Brannan, Ft. Lauderdale; Jorge Luis Garcia, Plantation; Jerry Ray Nichols, Boynton Beach; Masaru Tokiyama, Coral Springs, all of Fla.

[73] Assignee: Motorola, Inc., Schaumburg, Ill.

[21] Appl. No.: 691,187

[22] Filed: Aug. 5, 1996

[51] Int. Cl.[6] ..... H04R 25/00

[52] U.S. Cl. ..... 381/169; 381/168; 174/65 R

[58] Field of Search ..... 381/168, 169, 381/177, 188, 205, 91, 122, 155, 170, 157; 379/438; 361/748, 752, 759, 826; 174/59, 60, 62, 64, 65 R, 65 SS, 65 G

[56] References Cited

U.S. PATENT DOCUMENTS

| | | | |
|---|---|---|---|
| 2,787,675 | 4/1957 | Meshirer et al. | 381/168 |
| 4,199,721 | 4/1980 | Ono et al. | 381/168 |
| 4,385,209 | 5/1983 | Greason et al. | 381/169 |
| 4,926,398 | 5/1990 | Fincher | 381/169 |
| 5,249,235 | 9/1993 | Davis, II et al. | 381/91 |

*Primary Examiner*—Huyen D. Le
*Attorney, Agent, or Firm*—Dale W. Dorinski

[57] ABSTRACT

A microphone (10) for a two-way radio has front (12) and rear (14) housing assemblies, a PTT button (48) and a detachable power cable (18). The front housing (20) has a microphone opening (22) and an integrally formed hoop (36) on the lower part of the housing. A waterproof membrane (32) covers the opening and protects a microphone cartridge (24). A grill (34) snaps to the front housing, securing the membrane in place. The PTT button actuates a PTT switch through an elastomeric boot (50) which seals the microphone and also acts as a return spring for the PTT button. The rear housing (40) has a hoop receiver (38) on the lower part of the housing to receive the hoop on the front housing, and the PTT button fits into the side of the housing. The detachable power cable snaps into the microphone, and is held in place with a locking collar (58) which engages the hoop. When the entire microphone is assembled, the locking collar is retained in the hoop to provide additional securing force, and an o-ring seal (46) is radially compressed between the front housing and the rear housing to provide a watertight seal around the microphone cartridge.

22 Claims, 2 Drawing Sheets

MICROPHONE FOR A TWO WAY RADIO

CROSS REFERENCE TO RELATED APPLICATIONS

This application is related to U.S. patent application Ser. Nos. 08/657,233, filed Jun. 3, 1996, 08/656,650, filed May 31, 1996, and 29,038,243, filed May 1, 1995, all assigned to Motorola, Inc.

TECHNICAL FIELD

This invention relates in general to microphones, and more particularly, to microphones that are resistant to moisture.

BACKGROUND

Many electronic devices provide an external interface, such as a keypad, knob, or button, to support operational control by a user. In a typical electrical device, the housing protects the internal components, and external controls interface with these internal components through openings in the housing. Generally, an electronic device should be sealed to provide protection against environmental contaminants such as dust and water. One example of a popular user interface is a remote microphone for use with two-way radios. These microphones contain an externally actuated push-to-talk (PTT) switch that activates the microphone and simultaneously enables a transmission mode in the two-way radio. Generally, the PTT switch assembly includes an external actuator, such as a lever, and is designed to provide good tactile response, so that the user receives positive feedback indicating that the switch has been activated.

External microphones should be ruggedly designed to withstand significant physical abuse. Prior art microphone housings are typically made of metal castings or engineering plastics, and are held together using screws, adhesives, or ultrasonic welds to hold the various pieces of the housings together. These designs lead to increased labor and potential defects, both in the factory and in the field, from improper staking or welding, among other problems. Another source of failures during use is the cable which connects the microphone to the two-way radio. If the cable fatigues or fails and it is not replaceable, then the entire microphone assembly must be replaced. Microphone housings that are adhesively bonded or ultrasonically welded together cannot be opened for servicing and, thus, any damage to the cable will also require the entire assembly to be replaced.

Microphone housings made from plastic suffer from the limitations of a single color in the molding process. Some techniques, such as two-shot molding, circumvent this problem by utilizing two different plastics molded in two different steps. However, this is expensive and cumbersome, and the designer who wishes to provide a multi-colored plastic microphone is forced to choose from the expensive double-shot molding process or must resort to painting.

Further ultrasonically-welded assemblies and assemblies that are screwed together often suffer from a lack of adequate water sealing. Since external microphones are subject to great physical abuse and often become exposed to rain or are immersed in water, it is highly desirable to create a microphone that is water-resistant and/or submersible.

DETAILED DESCRIPTION OF THE PREFERRED EMBODIMENT

Figure 1:
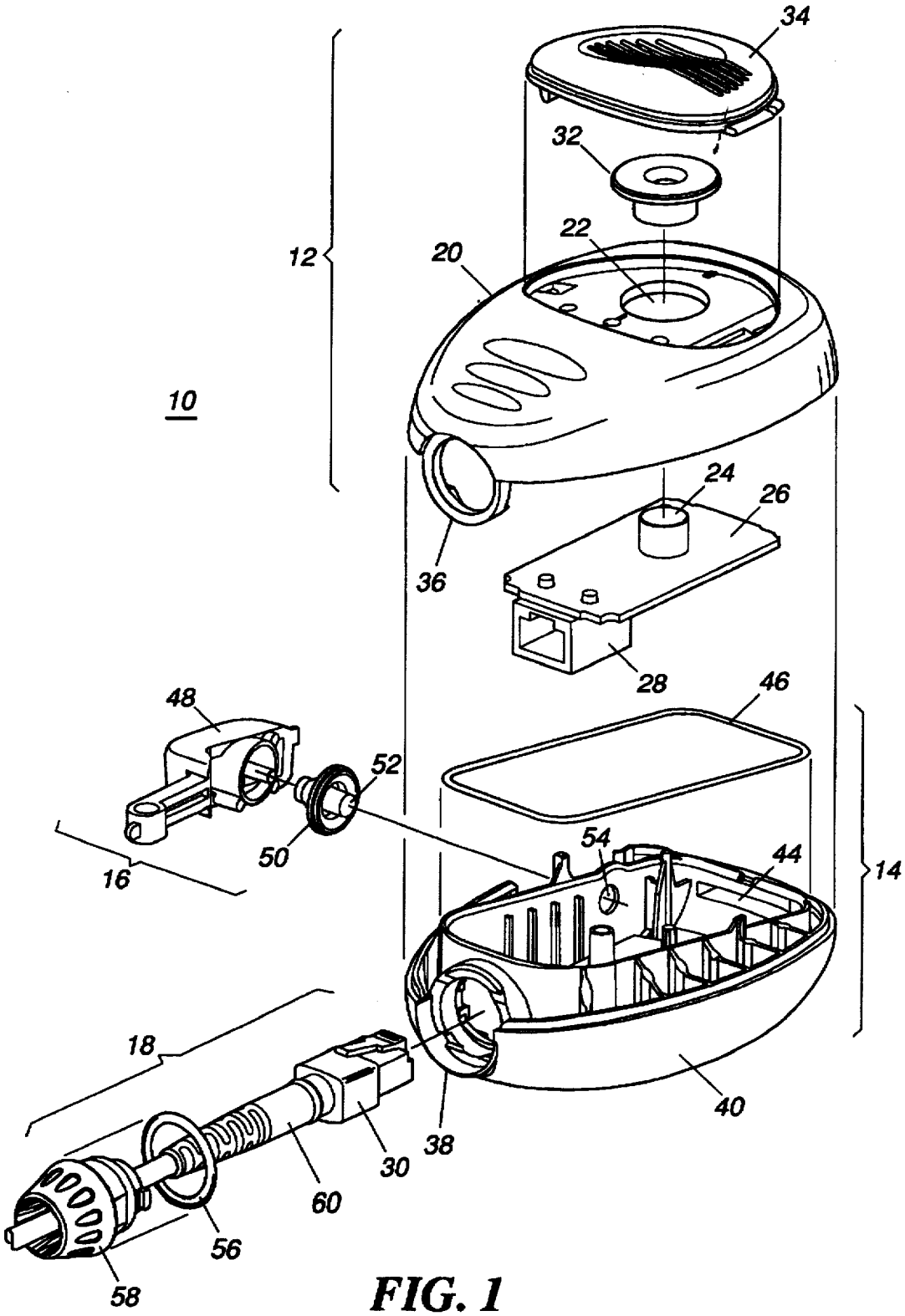
FIG. 1 is an exploded view of a microphone for a two-way radio in accordance with the invention.

A microphone for a two-way radio has front and rear housing assemblies, a push-to-talk (PTT) button, and a detachable power cable. The front housing has a microphone opening and an integrally formed hoop on the lower part of the housing. A waterproof membrane covers the microphone opening and protects a microphone cartridge which is situated inside the housing. A grill or bezel snaps to the front housing securing the membrane in place. This also provides an opportunity to create a color differentiation on the exterior of the microphone. The PTT button actuates a PTT switch through an elastomeric boot which seals the microphone housing and also acts as a return spring for the PTT button. The rear housing has a hoop receiver on the lower part of the housing to receive the hoop from the front housing, and the PTT button fits into the side of the housing. A detachable power cable attaches to the microphone through a keyed interconnect. It is held in place with a locking collar that engages the hoop. When the entire microphone is assembled, the locking collar is captured in the hoop, and an o-ring seal is radially compressed between the front housing and the rear housing halves to provide a watertight seal around the microphone cartridge. Two o-rings between the locking collar and hoops and between the locking collar and the overmolded cable provide a water-tight seal where the cable enters the housing. The cable can be easily replaced without disassembling the housing by simply unlocking the collar and unsnapping the jack. The PTT switch provides good tactile response and feedback to the user, reducing fatigue by providing a reduced resistance once the switch has been engaged.

While the specification concludes with claims defining the features of the invention that are regarded as novel, it is believed that the invention will be better understood from a consideration of the following description in conjunction with the drawing figures. The microphone 10 consists of a front housing assembly 12 a rear housing assembly 14, a PTT assembly 16, and a detachable power cable 18. Referring now to the front housing assembly 12, a front housing half 20 is preferably made of an injection-molded engineering plastic such as a polycarbonate. However, alternate embodiments may employ other plastics or metals such as aluminum or steel. The front housing half 20 contains an opening or aperture 22 for a microphone cartridge 24 which is carried by a printed circuit board (PCB) 26. The PCB 26 also contains a connector 28 which is used to receive a mating jack 30 from the power cable assembly 18. In the preferred embodiment, the PCB 26 snaps into friction lock tabs in the front housing and is located by use of a post in the housing and a slot in the circuit board. A sealing boot 32 is preferably made from an elastomer such as silicone or other type of rubber materials, and contains a very thin membrane. The thin membrane serves to cover the microphone cartridge 24 and to seal it against transmission of moisture, but is thin enough to allow quality transmission of sound from the user to the microphone. The sealing boot 32 is located above the microphone cartridge 24 and is situated to seal the aperture 22 in the front housing 20. The sealing boot 32 is held in place with a grill or bezel 34 which snaps into place in the front housing 20 by means of tabs, slots, and hooks. The exact configuration of the snap-in mechanism is left to the design of the user, as snaps and hooks are well known in the art and need not be elaborated upon here. The grill cover 34 is preferably fashioned from an injection-molded plastic material similar to that used for the front housing half 20 and is preferably in a contrasting color from the front housing. However, alternate embodiments may find the use of different materials such as metals or other types of plastics, and these materials may also be decorated or colored in a variety of fashions. The ability to snap in a separate piece part as a grill, provides the designer with the freedom to create microphones that have a multiplicity of colors on the front housing and also allows for grills of various types of design to be used on the same housing, thus adding product differentiation at a very low cost. The grill 34, when snapped into place on the front housing 20, serves to secure the sealing boot 32 in place without the use of adhesives or other mechanical fasteners.

Figure 2:
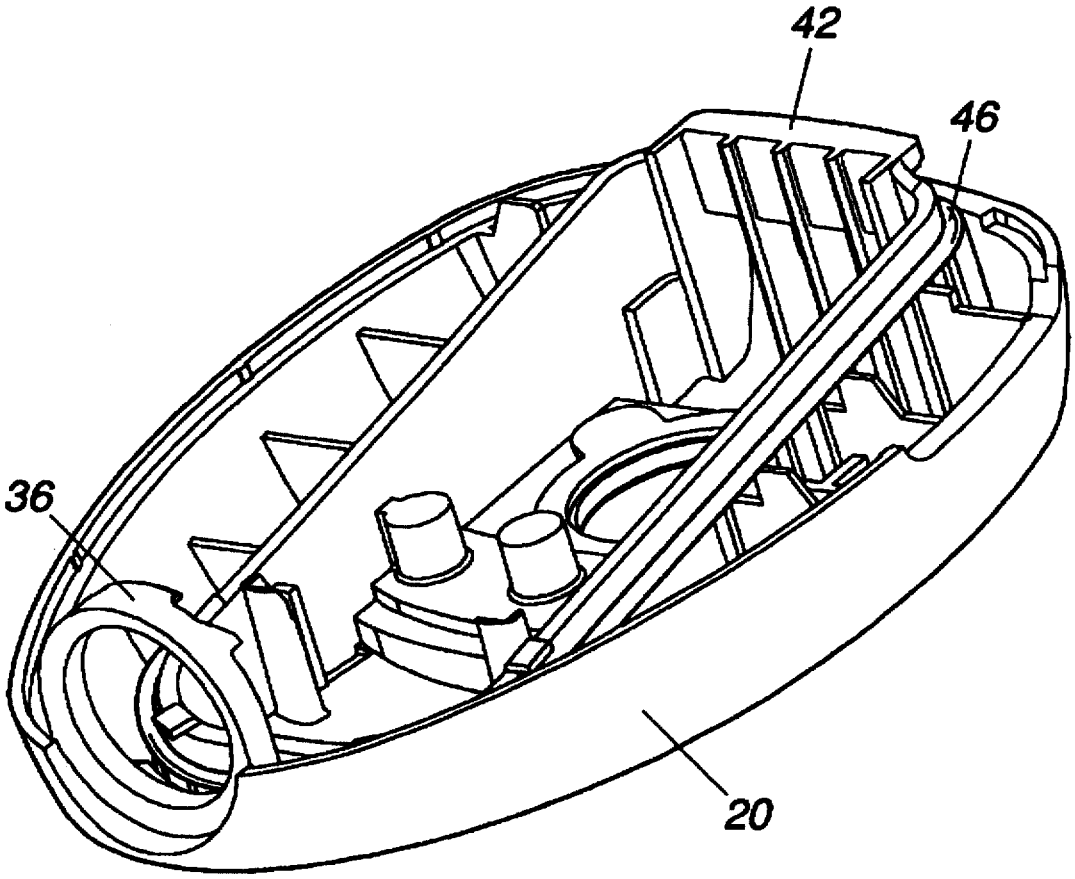
FIG. 2 is an isometric view of the interior of a front housing for a microphone.

The front housing 20 also contains a hoop 36 on the lower portion of the front housing. The hoop 36 serves as a receptacle for the power cable assembly 18 and also mates to a hoop receiver 38 located on a bottom portion of the rear housing 40. In the preferred embodiment, the hoop 36 contains tabs that engage with mating slots in the hoop receiver 38. However, alternate embodiments may find the slots on the hoop 36 and the tabs on the hoop receiver 38. Referring now to FIG. 2, showing the obverse side of the front housing 20, a tab or hook 42 near the top portion of the front housing protrudes to engage into a corresponding slot 44 near the top of the rear housing 40. An o-ring seal 46, shown in FIGS. 1 and 2, is also carried by the front housing 20 and is radially compressed between the front and rear housings when the two are assembled. The o-ring seal 46 in combination with the sealing boot 32 serves to provide a water-tight seal around the interior of the microphone 10, thus insulating the microphone cartridge 24, printed circuit board 26, and connector 28 from contamination by dust and/or moisture.

Returning back to FIG. 1, the PTT assembly 16 consists of an actuator button 48 and a resilient actuator member 50 that functions as a combination seal, return spring means, and switch actuator. The resilient actuator member 50 is preferably formed from an elastomer such as silicone or polyurethane rubber in a single piece molded construction. The resilient actuator member includes a peripheral base that supports a centrally disposed actuator portion and a conical side wall. The conical side wall provides a return spring force for the PTT switch. In addition, there is an actuator 52 that protrudes through an opening 54 in the rear housing 40. When the FIT assembly 16 is positioned within the PTT assembly receiving area on the rear housing, the resilient actuator member 50 seals against an interior wall of the rear housing, and the actuator 52 protrudes through the opening 54 to actuate a switch (not shown) on the PCB 26. The resilient actuator member 50 provides a seal on the wall of the housing to prevent intrusion of dust, water or other environmental contaminants into the interior of the microphone 10.

To assemble the microphone 10, the PTT assembly 16 is placed into the rear housing so that the resilient actuator member 50 presses against the interior housing wall and the actuator 52 protrudes through the opening 54. The front housing assembly 12 is then mated to the rear housing assembly 14 by engaging the tab 42 into the slot 44 and rocking the front housing down into place such that the hoop 36 engages into the hoop receiver 38. The tabs and slots on the hoop and corresponding hoop receiver then engage to hold the front housing assembly 12 secure to the rear housing assembly 14. This assembly process also compresses the o-ring seal 46. The latching mechanism provided by the engagement of the tab 42 into the slot 44 and the engagement of the hoop 36 into the hoop receiver 38 assures that the two halves of the housings remain assembled when the cable is not in place.

After the housings are assembled together, the jack 30 on the end of the detachable power cable assembly 18 is plugged into the connector 28 by inserting the end of the power cable assembly through the assembled hoop and hoop receiver. A second o-ring 56 on the detachable power cable serves to provide a water seal between the cable and the microphone 10. After the jack has been plugged into the connector, the locking collar 58 is moved along the cable to seat the o-ring 56 against a corresponding surface in the assembled housings. The locking collar 58 grips corresponding tab openings in the housing assembly. In the preferred embodiment, the locking collar is turned 90° clockwise to lock it into place over detents in the rear housing. The locking collar 58 captures the hoop on the front housing coaxially with the hoop receiver in the rear housing to further serve to maintain the assembled microphone in a "locked together" position. This assembly scheme provides significant resistance to accidental removal of the power cable, requiring over sixty pounds of force to be forcibly disengaged from the microphone. A strain relief 60 is also provided on the detachable power cable in a conventional manner.

All openings in the assembled microphone 10 are now sealed by a variety of elastomer seals, such as the sealing boot 32, the o-ring 46, the resilient actuator member 50, and the cable o-ring 56, thus providing a microphone assembly that can be submersed under water to a level of three feet. Further, this assembly has entirely eliminated the need for screws, ultrasonic welding, or other types of adhesives, since everything is held in place by proper design and the use of snap fits. The detachable power cable can be easily removed by pushing the locking collar 58 inwardly past the detents and then turning it 90° counterclockwise. This releases the collar from the housing assembly and allows the jack 30 to be disengaged from the connector 28. This provides a field serviceable configuration of the microphone. If the power cable 18 is accidentally damaged or if the microphone needs to be connected to a radio having a different type of connector, the cable can be easily replaced.

In summary, an external microphone for a two-way radio has been created that solves problems of the prior art. In particular, the microphone is water resistant and submersible to a level of three feet. This is provided by a plurality of seals strategically located throughout the assembly. The microphone is further assembled without the use of adhesives, screws, ultrasonic welding or other external mechanical fasteners. The microphone contains a snap-in grill that can be easily removed to provide flexibility in the design and the ornamental features. It further contains a PTT switch that provides improved tactile feedback to the user, along with water sealing capabilities. A detachable power cable can be easily removed and replaced without having to disassemble the entire microphone. The microphone assembly is held together and self contained when the power cable is removed, while the power cable provides further retaining force to keep the assembled microphone together. These and other features provide significant advantages over the prior art.

While the preferred embodiments of the invention have been illustrated and described, it will be clear that the invention is not so limited. For example, the hoops and hoop receivers as described need not be closed or circular. Various configurations of tabs and slots may also be employed in alternatives of those configurations shown in the drawing figures. Further, the microphone assembly 10 may contain other features, for example, keypads and so forth may be incorporated into the snap-on grill 34. Numerous modifications, changes, variations, substitutions and equivalents will occur to those skilled in the art without departing from the spirit and scope of the present invention as defined by the appended claims.

What is claimed is:

1. A microphone for a two-way radio, comprising in combination:

a front housing assembly, comprising;

a front housing having an aperture formed therein and having a hoop on a lower portion of the front housing;

a grill secured to the front housing; and a membrane covering the aperture and disposed between the grill and the front housing;

a PTT assembly, comprising a PTT button and a spring means to urge the PTT button outwards from the microphone;

a rear housing assembly, comprising;

a rear housing having a hoop receiver on a lower portion of the rear housing and having a PTT receiving portion on a side portion of the rear housing; and the PTT assembly disposed within the PTT receiving portion;

a power cable having a locking collar to engage the hoop; and wherein the hoop engages the hoop receiver, the power cable is routed through the hoop, and the locking collar is retained in the hoop when the front housing assembly is assembled to the rear housing assembly.

2. The microphone for a two-way radio as described in claim 1, wherein the assembled microphone is submersible.

3. The microphone for a two-way radio as described in claim 1, wherein the front housing assembly is secured to the rear housing assembly without the use of adhesives, screws or ultrasonic welding.

4. The microphone for a two-way radio as described in claim 1, wherein the front housing assembly is secured to the rear housing assembly by means of snap fits.

5. The microphone for a two-way radio as described in claim 1, wherein the locking collar additionally serves to secure the front housing assembly to the rear housing assembly.

6. The microphone for a two-way radio as described in claim 1, wherein the grill is a different color than the front housing.

7. The microphone for a two-way radio as described in claim 1, wherein one or both housings are plastic.

8. The microphone for a two-way radio as described in claim 1, wherein the grill is plastic.

9. The microphone for a two-way radio as described in claim 1, wherein the grill is secured to the front housing by means of a snap fit.

10. The microphone for a two-way radio as described in claim 1, wherein the membrane is held in place by compression between the grill and the front housing.

11. The microphone for a two-way radio as described in claim 1, further comprising a microphone cartridge mounted on a printed circuit board, the printed circuit board carried by the front housing.

12. The microphone for a two-way radio as described in claim 11, wherein the membrane serves to exclude water from contacting the microphone cartridge.

13. The microphone for a two-way radio as described in claim 11, further comprising a pluggable jack on the power cable.

14. The microphone for a two-way radio as described in claim 13, wherein the pluggable jack mates with a connector carried by the printed circuit board.

15. The microphone for a two-way radio as described in claim 1, further comprising a tab on an upper portion of the front housing which engages a groove in an upper portion of the rear housing.

16. The microphone for a two-way radio as described in claim 1, wherein the hoop on the front housing locks into the hoop receiver on the rear housing by engaging a tab on the rear housing.

17. The microphone for a two-way radio as described in claim 1, wherein the spring means also provides a water seal to the assembled microphone.

18. The microphone for a two-way radio as described in claim 17, wherein the spring means is an elastomeric boot.

19. The microphone for a two-way radio as described in claim 1, wherein an o-ring seal is radially compressed between the housings when the front housing assembly is assembled to the rear housing assembly.

20. The microphone for a two-way radio as described in claim 1, further comprising a strain relief on the power cable.

21. A submersible microphone for a two-way radio, comprising in combination:

a front housing assembly, comprising;

a plastic front housing having an aperture formed therein and having an integrally formed hoop on a lower portion of the front housing;

a grill secured to the front housing by means of a snap fit, the grill overlying the aperture;

a membrane covering the aperture and disposed between the grill and the front housing; and a microphone cartridge aligned with the aperture and situated behind the membrane;

a PTT assembly, comprising;

a PTT button;

an actuator; and a spring means to urge the PTT button away from a rear housing;

a rear housing assembly, comprising;

a plastic rear housing having a hoop receiver on a lower portion of the rear housing and having a PTT receiving portion on a side portion of the rear housing; and the PTT assembly disposed within the PTT receiving portion;

a detachable power cable having a locking collar to engage the hoop; and wherein the hoop engages the hoop receiver, the detachable power cable is routed through the hoop, the locking collar is retained in the hoop, and an o-ring seal is radially compressed between the front housing and the rear housing when the front housing assembly is connected to the rear housing assembly by means of snap fits.

22. A submersible microphone for a two-way radio, comprising in combination:

a front housing assembly, comprising;

a plastic front housing having an aperture formed therein and having an integrally formed hoop on a lower portion of the front housing;

a plastic grill secured to the front housing by means of a snap fit, the grill overlying the aperture;

a membrane seal covering the aperture and disposed between the grill and the front housing, the membrane seal serving to prevent water from entering the submersible microphone; and a printed circuit board disposed in the front housing, the printed circuit board carrying a connector and a microphone cartridge, the microphone cartridge aligned with the aperture and situated behind the membrane seal;

a PTT assembly, comprising;

a PTT button;

an actuator; and an elastomeric boot that functions as a spring to urge the PTT button outward and functions as a water seal to prevent water from contacting the microphone cartridge;

a rear housing assembly, comprising;

a plastic rear housing having a hoop receiver on a lower portion of the rear housing and having a PTT receiving portion on a side portion of the rear housing; and the PTT assembly disposed within the PTT receiving portion;

an o-ring seal disposed between the front housing and the rear housing and surrounding the printed circuit board to prevent water from contacting the printed circuit board;

a detachable power cable having a jack and having a locking collar to engage the hoop; and wherein a tab on an upper portion of the front housing engages a groove in an upper portion of the rear housing, the hoop engages and locks into the hoop receiver by engaging a tab on the rear housing, the detachable power cable is routed through the hoop so that the jack mates with the connector, the locking collar is retained by the engaged hoop and hoop receiver to secure the front housing to the rear housing when the front housing assembly is connected to the rear housing assembly without the use of screws, adhesives or ultrasonic welding.

* * * * *

UNITED STATES PATENT AND TRADEMARK OFFICE

CERTIFICATE OF CORRECTION

PATENT NO. : 5,701,355

DATED : December 23, 1997

INVENTOR(S) : Brannan, et al.

It is certified that error appears in the above-identified patent and that said Letters Patent is hereby corrected as shown below:

Column 8, line 13, after "by the" delete "engaged" ; before the second occurrence of "hoop" insert --the--.

Signed and Sealed this

Fourteenth Day of July, 1998

Bruce Lehman

*Attest:*

BRUCE LEHMAN

*Attesting Officer*

*Commissioner of Patents and Trademarks*